US009156030B2

(12) United States Patent
Beese

(10) Patent No.: US 9,156,030 B2
(45) Date of Patent: Oct. 13, 2015

(54) PIPETTE TIP

(71) Applicant: Eppendorf AG, Hamburg (DE)

(72) Inventor: Jochen Beese, Norderstedt (DE)

(73) Assignee: Eppendorf AG, Hamburg (DE)

( * ) Notice: Subject to any disclaimer, the term of this patent is extended or adjusted under 35 U.S.C. 154(b) by 233 days.

(21) Appl. No.: 13/713,954

(22) Filed: Dec. 13, 2012

(65) Prior Publication Data

US 2013/0213151 A1 Aug. 22, 2013

Related U.S. Application Data

(60) Provisional application No. 61/580,838, filed on Dec. 28, 2011.

(51) Int. Cl.
*B01L 3/02* (2006.01)

(52) U.S. Cl.
CPC ..... *B01L 3/021* (2013.01); *B01L 3/0279* (2013.01); *B01L 3/0275* (2013.01); *B01L 2200/0689* (2013.01)

(58) Field of Classification Search
CPC ..... B01L 3/021; B01L 3/0275; B01L 3/0279; B01L 200/025; B01L 2200/026; B01L 2200/087; B01L 2200/0689
USPC ..... 73/864.01, 864.14; 422/525, 931
See application file for complete search history.

(56) References Cited

U.S. PATENT DOCUMENTS

| | | | | |
|---|---|---|---|---|
| 4,072,330 | A * | 2/1978 | Brysch | 73/864.14 |
| 5,200,151 | A | 4/1993 | Long | |
| 5,232,669 | A * | 8/1993 | Pardinas | 422/526 |
| 6,197,259 | B1 | 3/2001 | Kelly et al. | |
| 7,335,337 | B1 | 2/2008 | Smith | |
| 7,339,373 | B2 | 3/2008 | Seki et al. | |
| 8,202,495 | B1 * | 6/2012 | Smith | 422/524 |

FOREIGN PATENT DOCUMENTS

| | | |
|---|---|---|
| DE | 25 26 296 B1 | 12/1976 |
| EP | 1520624 A1 | 4/2005 |
| EP | 2 138 234 A1 | 12/2009 |

* cited by examiner

*Primary Examiner* — Daniel S Larkin
(74) *Attorney, Agent, or Firm* — Vidas, Arrett & Steinkraus, P.A.

(57) ABSTRACT

A pipette tip having the shape of an elongate small tube with a lower opening at the lower end for the passage of liquid, and an upper opening at the upper end, wherein a seat area exists on the inner circumference contiguous to the upper opening, which serves for plugging it onto a standardized conical attachment piece of a pipetting device, wherein the seat area has a retaining area with axially extending ribs projecting radially towards the inside, and below the retaining area a sealing area and is configured such that when the pipette tip is plugged onto the attachment piece with its seat area by a plugging force which ensures retaining and sealing of the pipette tip on the attachment piece, the ribs are partly plastically deformed, and elastic deformation occurs in the seat area outside of the ribs.

18 Claims, 8 Drawing Sheets

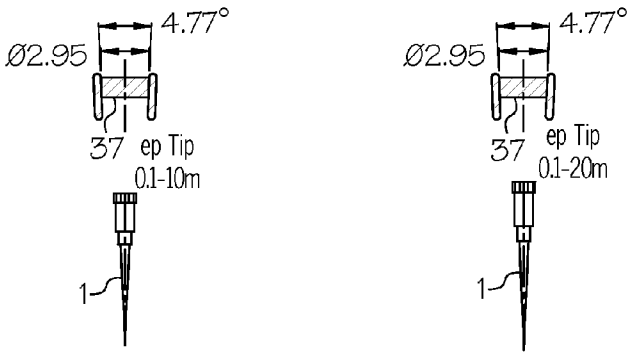
FIG. 5A
FIG. 5B
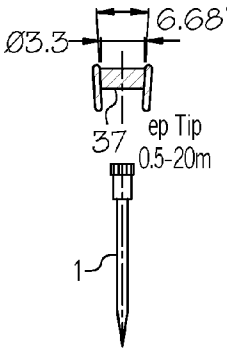
FIG. 5C
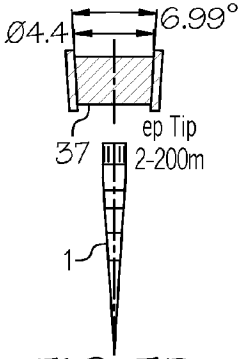
FIG. 5D
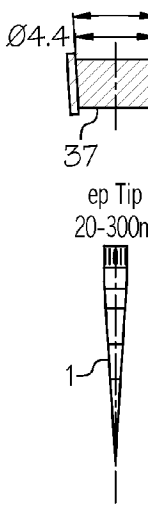
FIG. 5E
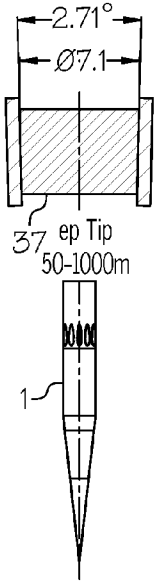
FIG. 5F
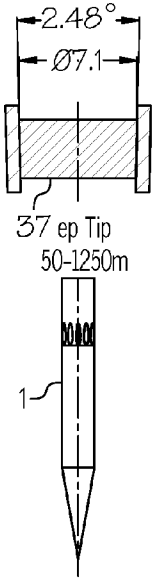
FIG. 5G
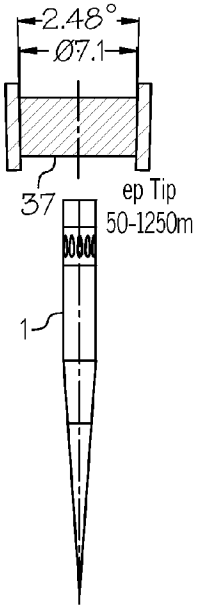
FIG. 5H

PIPETTE TIP

CROSS-REFERENCE TO RELATED APPLICATIONS

This is a Utility application which claims priority to Provisional Application 61/580,838, filed on Dec. 28, 2011.

STATEMENT REGARDING FEDERALLY SPONSORED RESEARCH

Not applicable.

BACKGROUND OF THE INVENTION

The present invention relates to a pipette tip.

Together with pipettes and other metering devices, pipette tips are used for metering liquids. In the following, pipettes and metering devices are summarized as "pipetting devices". Pipette tips have an elongate, tubular body, which has a pipetting opening at the lower end, and a plug-up opening for plugging it onto an attachment piece of a pipetting device. Standardized conical attachment pieces with a standard geometry are known, which are uniformly used by many manufacturers and which are characterised for each pipette tip by a specific average diameter and by a specific cone angle of the conical attachment piece.

BRIEF DESCRIPTION OF THE INVENTION

The pipetting device comprises a gas displacer element, which is mostly a piston with a cylinder axially movable therein. The gas displacer element is connected to a passage hole of the attachment piece. The pipette tip is sealingly clamped to the attachment piece by pressing the attachment piece of the pipette into the upper opening of the pipette tip.

An air column is displaced by means of the gas displacer element, in order to aspirate liquid for the pipette tip sitting on the attachment piece, or to eject it from the same. When the air column is moved away from the pipette tip, a certain amount of liquid is aspirated into the pipette tip through the lower opening. By moving the air column towards the pipette tip, an amount of liquid is discharged out of the pipette tip through the lower opening.

Pipetting devices have mostly an ejector, which acts on the upper edge of the pipette tip to push it off from the attachment piece. Through this, it is avoided that the user has to touch the contaminated pipette tip in order to detach it from the attachment piece.

The pipetting device can be a hand-held pipette which the user can hold and operate with only one hand. The pipetting device can also be a metering station, or be integrated into a work station. In all the cases, the gas displacer element can be operated manually or by motor. Plugging on and ejection of the pipette tip can also take place manually or by motor.

In order to avoid erroneous pipetting actions, the pipette tip must be sealingly fixed on the attachment piece. In addition, the forces for plugging on and for the ejection of the pipette tip from the attachment piece must not be too high. In conventional pipette tips, the contact area between the pipette tip and the conical attachment piece is like a truncated cone. When plugging on the pipette tip, the pipette tip is elastically expanded at its circumference by the attachment piece. The spring characteristics is steep, so that high plugging forces must be used. After plugging on, a correspondingly high static friction acts between the attachment piece and the pipette tip. This static friction must be overcome when the pipette tip is ejected. The user is burdened by the high forces for plugging on and ejecting the pipette tip. As far as plugging on and ejection take place by motor drives, these must be correspondingly powerful and they have high energy consumption.

The document U.S. Pat. No. 6,197,259 B1, the entire contents of which is incorporated herein by reference, describes a pipette tip which can be mounted to and ejected from an attachment piece of a pipette easily and firmly by application of relatively small axial plugging- and ejection forces of six and three pounds (26.7N and 13.3N, respectively). The pipette tip has a tubular pipette portion which has a conical upper end with an inner diameter at its upper end which is greater than the diameter of the attachment piece of the pipette onto which the pipette tip is to be plugged on. Further, the pipette tip has a hollow centre portion and an annular sealing area at the connection between the upper end and the centre portion. The annular sealing area has an inner diameter which is smaller than a value "x" and is designed such that it engages with the lower end of a sealing zone of the attachment piece, so as to be radially expanded towards the outside when the attachment piece is inserted, whereby a liquid-tight sealing between the sealing zone of the attachment piece and the sealing area of the pipette tip is produced. Further, the pipette tip has lateral stabilisation means at the inner side next to the sealing area, which engage with the outer surface of the attachment piece in order to stabilise the pipette tip on the attachment piece. These lateral stabilisation means have at least three contacts that are spaced apart in the circumferential direction, which extend from the inner surface of the pipette tip towards the inside. The diameter distance of the contacts is dimensioned such that they easily engage with the free end of the attachment piece and make it possible that the lower end of the attachment piece slides along without expanding the side walls of the pipette tip, on which the contacts are disposed. The contacts effect a lateral support of the pipette tip on the attachment piece, in order to prevent the pipette tip from moving sideways when lateral exterior forces act on the pipette tip, like when a liquid is stripped off on a wall. When the lower end of the sealing zone of the attachment piece engages the sealing area of the pipette tip, the pipette tip is expanded in the sealing area and immediately next to it. When the contacts guide the tip on the attachment piece and align it stably and safely on the attachment piece, the side wall of the pipette tip which bears the contact is deformed inward and is not expanded, whereby only a minimal force is exerted to the attachment piece in the insertion.

The document U.S. Pat. No. 7,339,373 B1, the entire contents of which is incorporated herein by reference, describes an ergonomically designed pipette tip, which can be safely plugged onto a shaft of a pipette, while the axial force to be spent for plugging and ejecting is significantly reduced at the same time. The ergonomic pipette tip comprises thin expansion gaps made in the injection moulding, which are flanked by thicker wall segments, and/or a second elastic material, in order to reduce the force necessary for expanding the upper edge of the pipette tip according to the bending spring principle when the pipette shaft is introduced into the sealing area of the pipette tip. Moreover, the pipette tip has one or several projections on its inner side, which are intended to limit the plug-in depth of the pipette shaft into the pipette tip as stoppers.

The document EP 1 520 624 B1, the entire contents of which is incorporated herein by reference, describes a pipette tip of plastics with an elongate tubular body, which has a pipetting opening at a lower end, and a plug-on opening for plugging onto a fixture shaft of a pipetting device at an upper end. Near to the upper end, the pipette tip has a ligament, circulating along a closed curve and having different distances from the lower end at different circumferential positions. The circulating ligament has a contact area at the inner side, which circulates on a rotational plane. Further ligaments extend up to the upper end, starting from the positions of the circulating ligament maximally distant from the lower end. With the contact area on the inner side of the circulating ligament, the pipette tip comes into sealing contact with the attachment piece of a pipetting device. When ejecting, the ejector of the pipetting device pushes against the further ligaments at the upper end of the pipette tip. By the further ligaments, the ejection force is transmitted to the positions of the circulating ligament maximally distant from the lower end. These positions of the circulating ligament are thereby somewhat pressed towards the lower end. Relative to a plane that is oriented at right angles to the tubular body of the pipette tip, the circulating ligament is pressed to become somewhat flatter. The further ligaments form a stiff area, which is subject to only relatively weak deformation in the transmission of forces. Because the circulating ligament is oriented crosswise to the further ligaments, it can be deformed relatively easily by the forces introduced in the direction of the further ligament. As a consequence, the circulating ligament expands somewhat, and the static friction between the inner side of the circulating ligament or the contact area and the attachment piece, respectively, is correspondingly reduced. Thus, the forces necessary for detaching the pipette tip from the fixture shaft are reduced. Moreover, the pipette tip is more flexible in the area of the circulating ligament, so that even the forces for plugging it onto an attachment piece are reduced, and plugging onto fixture shafts having different dimensions is favoured.

In the pipette tips of the above documents, dimensional variations of the pipette tip and the attachment piece are compensated by elastic expansion of the pipette tip. Higher forces for plugging and ejection will result when the inner diameter of the pipette tip in the seat area falls strongly below the standard size, or the outer diameter of the attachment piece strongly exceeds the standard size, respectively.

SUMMARY OF THE INVENTION

Starting from this, the present invention is based on the task to provide a pipette tip wherein the necessary ejection force for ejecting the pipette tip from the attachment piece of a pipetting device is reduced, and dimensional tolerances have less influence on the ejection force.

In one aspect, the present invention relates to a pipette tip having the shape of an elongate small tube with a lower opening (4) at the lower end (3) for the passage of liquid, and an upper opening (6) at the upper end, wherein a seat area (30) exists on the inner circumference contiguous to the upper opening (6). The seat area serves for plugging it onto a standardized conical attachment piece (37) of a pipetting device (30), wherein the seat area (30) has a retaining area (11) with axially extending ribs (12) projecting radially towards the inside, and below the retaining area (11) a sealing area (19). The sealing area is configured such that when the pipette tip (1) is plugged onto the attachment piece (37) with its seat area (30) by a plugging force which ensures retaining and sealing of the pipette tip (1) on the attachment piece (37), the ribs (12) are partly plastically deformed, and elastic deformation occurs in the seat area (30) outside of the ribs (12).

The pipette tip of the present invention has the shape of an elongate small tube with a lower opening at the lower end for the passage of liquid, and an upper opening at the upper end, wherein a seat area exists on the inner circumference contiguous to the upper opening, which serves for plugging it onto a standardized conical attachment piece of a pipetting device, wherein the seat area has a retaining area with axially extending ribs projecting radially towards the inside, and below the retaining area a sealing area, and is configured such that when the pipette tip is plugged onto the attachment piece with its seat area by a plugging force which ensures retaining and sealing of the pipette tip on the attachment piece, the ribs are partly plastically deformed, and elastic deformation occurs in the seat area outside of the ribs.

When the pipette tip of the present invention is plugged onto a standardized conical attachment piece of a pipetting device, surface pressure in the area of the axial ribs causes a partial plastic deformation of the axial ribs. Further, the pipette tip is elastically deformed in the seat area outside of the elastic ribs. A part of the plugging force is consumed for the plastic deformation of the ribs, and another part of the plugging forces is stored in the elastic deformation. As a result, the pipette tip is held on the attachment piece under bias. The ribs support the pipette tip laterally, so that it does not shake under the influence of lateral forces. In order to eject the pipette tip, only the force stored by the elastic deformation must be overcome. When the pipette tip is being ejected, the part of the plugging force allotted to the plastic deformation of the axial ribs has not to be overcome as stored force anew. The ejection force must overcome the friction force which exists due to the elastic bias between pipette tip and attachment piece. Dimensional tolerances of pipette tip and attachment piece are compensated by the plastic deformation of the ribs and have less effect on the elastic deformation in the seat area than with conventional pipette tips. The influence of dimensional tolerances on the ejection force is reduced through this.

Thus, only a small ejection force must be spent for ejecting the pipette tip of the present invention from the attachment piece. This unburdens the user of a hand-held pipette with an ejector that is actuated by the thumb. The user can easily exert the necessary plugging force by forearm and hand. Likewise, motor driven ejectors are also unburdened by the pipette tip of the present invention.

The elastic deformation in the seat area can occur in the sealing area and/or in the retaining area between the ribs. The elastic deformation can be limited to the sealing area or to the area between the ribs, or it may take place in the sealing area as well as in the area between the ribs. The plastic deformation of the ribs and the elastic deformation in the seat area are determined by the geometry of the seat area and the material of the pipette tip. The plastic deformation of the ribs is determined by the rib profile in particular. The wall thickness of the pipette tip in the area of the ribs determines the amount of elastic deformation in this area. The wall thickness in the area of the ribs can be selected as great that the pipette tip behaves rigidly there, and only plastic deformation of the ribs takes place. Elastic or plastic deformation in the sealing area can be determined by the wall thickness of the pipette tip in the sealing area in particular, and as the case may be through the geometry of a sealing nose that circulates in the sealing area at the inside.

The standardized conical attachment pieces are defined by a certain average diameter and a certain cone angle for each size of pipette tips. This is summarized in the table below:

| Size of pipette tip (in microlitres) | Average diameter (in mm) | Cone angle (in degrees) |
|---|---|---|
| 0.1-10 | 2.95 | 4.77 |
| 0.1-20 | 2.95 | 4.77 |
| 0.5-20 | 3.3 | 6.68 |
| 2-20 | 4.4 | 6.99 |
| 20-30 | 4.4 | 6.99 |
| 50-1000 | 7.1 | 2.71 |
| 50-1250 | 7.1 | 2.48 |
| 500-2500 | 9.39 (?) | 1.9 (?) |
| 100-5000 | 12.4 (?) | 2.29 (?) |
| 1000-10 000 | 14.3 | 4.35 |
| 10-10 000 | 14.3 | 4.35 |

A tolerance of +/−0.05 mm applies for the diameter specifications, and a tolerance of +/−0.3° for the angle specifications.

According to one embodiment, the ribs are uniformly distributed over the circumference. Uniform deformation and support of the pipette tip in the seat area is favoured through this.

According to a further embodiment, the pipette tip has 3 to 12 ribs, preferably 5 to 7 ribs, and further preferably 6 ribs. Uniform support is achieved by this. The mentioned rib numbers have plastically deformable rib geometries that can be produced easily.

According to a further embodiment, the ribs are dimensioned such that their dimensional overlap with the standardized conical attachment piece, in relation the position which the attachment piece occupies when the pipette tip is plugged onto the attachment piece with its seat area by an plugging force which ensures retaining and sealing of the pipette tip on the attachment piece, is at least 0.1 mm, preferably at least 0.2 mm and/or maximally 0.5 mm, preferably maximally 0.3 mm. This dimensional overlap favours partial plastic deformation of the ribs.

According to a further embodiment, the pipette tip has, next to the upper opening at the inside, further axially extending ribs projecting radially towards the inside, which extend less far radially towards the inside than the ribs, the further ribs each being arranged between two ribs. The further ribs can serve for additional guiding of the pipette tip on the attachment piece, wherein the further ribs can be subject to no deformation, or only to a smaller deformation than the ribs, when the pipette tip is plugged onto the attachment piece. According to a preferred embodiment, the further ribs are dimensioned such that they are not deformed when the pipette tip is plugged onto the attachment piece by a plugging force which ensures retaining and sealing of the pipette tip on the attachment piece.

According to a further embodiment, the ribs and/or the further ribs have a profile which tapers in the direction radially towards the inside. Plastic deformation of the axial ribs at the inner end of the profile is favoured through this. According to a further embodiment, the ribs and/or the further ribs have a triangle-shaped or a trapezoidal or a parabolic profile.

According to a preferred embodiment, the pipette tip has flutings at the circumference on the outside, which overlap the ribs and/or the further ribs. The flutings serve for instance to make the pipette tip rigid in the rib area, or for characterising the pipette tip. In case that they serve for characterising the pipette tip, the arrangement of the flutings above the ribs and/or the further ribs favours the recognizability of the flutings on a transparent pipette tip. Otherwise, the ribs and/or the further ribs could be perceived as flutings.

According to a further embodiment, the pipette tip dilates conically towards the upper opening in the area in which the ribs are disposed, and/or in the sealing area. The insertion of the attachment piece of a pipetting device is favoured by this. In principle, the mentioned areas can have a circular-cylindrical shape instead of a conical one, provided that the ribs are matched to the standardized conical attachment piece by plastic deformation, and that there is a circulating sealing nose in the sealing area, by which the sealing area bears against the attachment piece.

According to a further embodiment, the sealing area has a sealing nose projecting towards the inside and circulating on the circumference at the inner side thereof. The sealing nose is for instance a sealing bead or a sealing lip.

According to a further embodiment, the pipette tip has in the area in which the ribs are disposed a wall thickness that is greater than its wall thickness in the sealing area. The pipette tip is stiffer in the area of the axial ribs, whereby the plastic deformation of the ribs is favoured.

According to a further embodiment, the pipette tip has means for limiting the plugging onto the standardized conical attachment piece, which stop the plugging onto the attachment piece when a plugging force is attained which ensures retaining and sealing of the pipette tip on the attachment piece and a partial plastic deformation of the ribs. The plastic deformation of the axial ribs can be limited to a suitable extent trough this. The means for limiting can be formed by an abutment, which is formed by one or several projections which project towards the inside from the inner circumference of the pipette tip.

According to a further embodiment, the means for limiting the plugging are a braking area which conically dilates below the sealing area towards the upper opening. When plugging onto the standardized conical attachment piece is performed, the lower edge of the attachment piece hits the braking area, and the introduction movement of the attachment piece is gradually stopped by the conical shape of the braking area. Through this, the user is less burdened than with a conventional abutment, which stops the plugging movement suddenly.

The pipette tip is preferably made of a plastic material. Further preferably, the pipette tip is made of a polyolefin, preferably of polypropylene or polyethylene. According to a further embodiment, the pipette tip is light-permeable, preferably transparent. Further preferably, the pipette tip is produced by injection moulding. The inner and/or outer diameter of the pipette tip preferably increases from the lower opening to the upper opening.

In the following, the present invention is explained in more detail by way of the attached drawings of an example of its realisation. In the drawings show:

DETAILED DESCRIPTION OF THE INVENTION

Figure 1A:
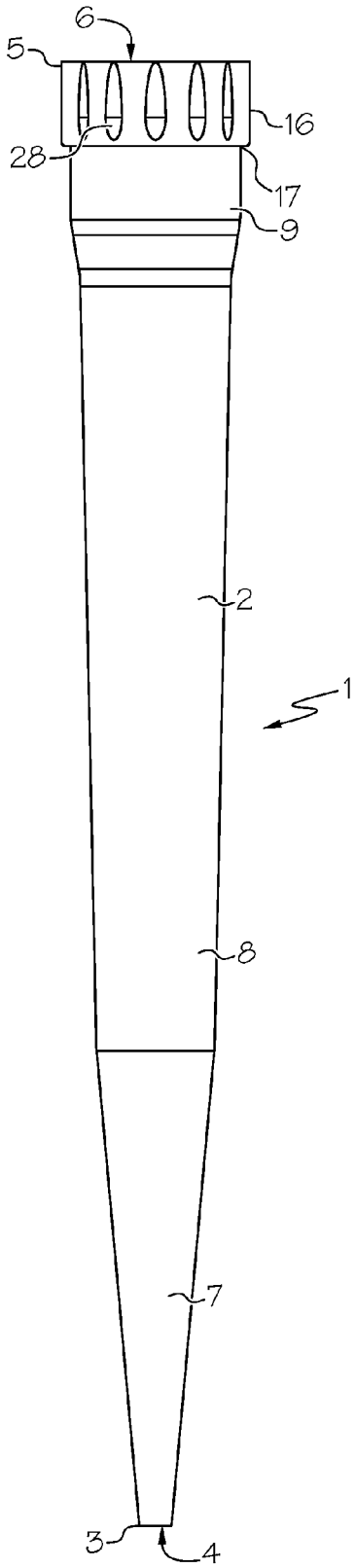
FIG. 1*a-e* a pipette tip with axial ribs and circulating sealing nose in a side view (FIG. 1*a*), in a longitudinal section (FIG. 1*b*), in an enlarged view from the downside (FIG. 1*c*), in an enlarged top view (FIG. 1*d*) and in a perspective view with break-out (FIG. 1*e*)
Figure 1B:
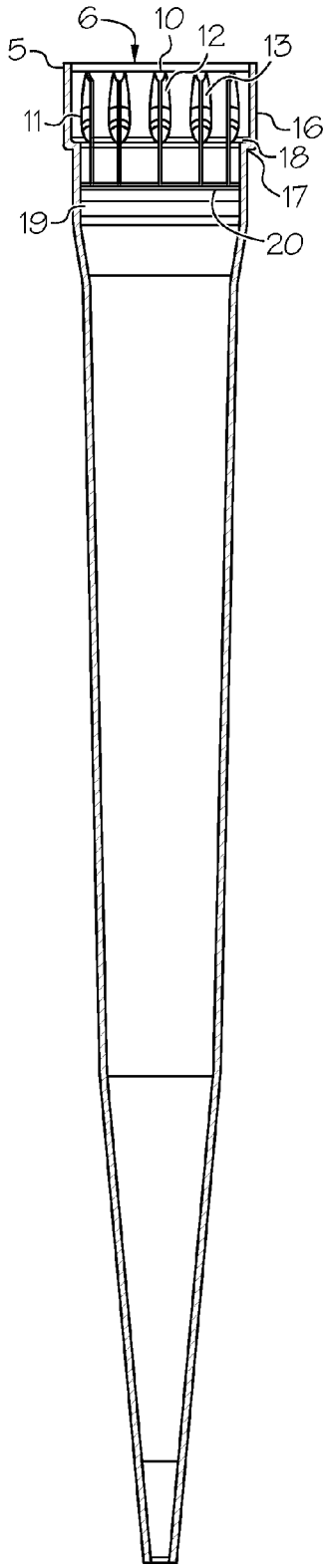
Figure 1C:
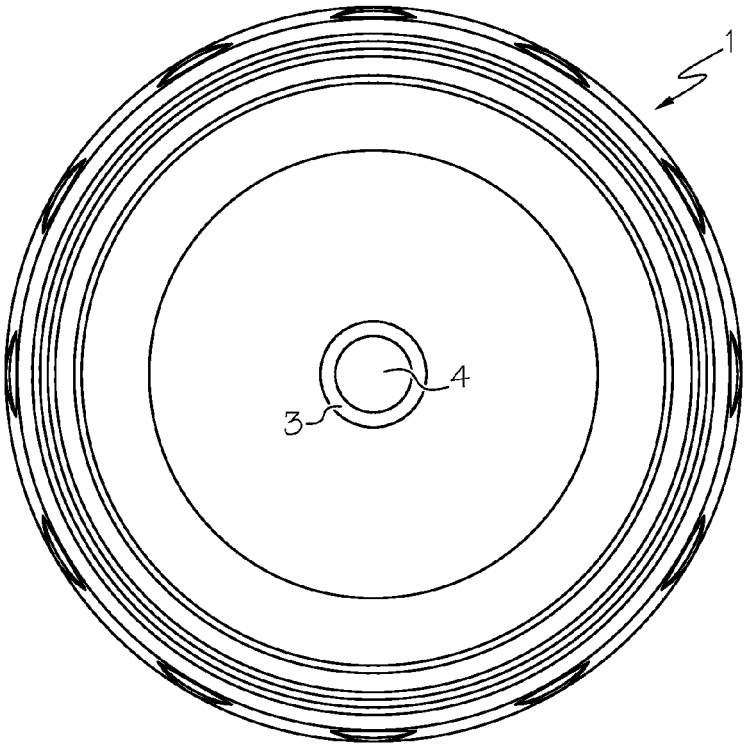

While this invention may be embodied in many different forms, there are described in detail herein a specific preferred embodiment of the invention. This description is an exemplification of the principles of the invention and is not intended to limit the invention to the particular embodiment illustrated.

In the present application, the designations "up" and "down" refer to an orientation of the pipette tip in the pipetting, in which the pipette tip is oriented vertically and the lower opening is at the downside and the upper opening at the topside.

In the following description of different realisation examples, coincident features are indicated by the same reference numerals.

According to FIG. 1, a pipette tip 1 has an elongate, tubular body 2, which has a lower opening 4 at the lower end 3 and a plugging opening 6 at the upper end 5. The lower opening 4 is smaller than the upper opening 6.

The inner and/or outer diameter of the tubular body 2 generally increases from the lower opening 4 to the upper opening 6. In the example, the tubular body 2 has a conical beginning portion 7 at the downside, above it a less conical centre portion 8 and above the former a head portion 9. A pipette tip 1 of the present invention can also dilate from the lower opening 4 to the upper opening 6 otherwise, in particular in portions or continuously.

Figure 1D:
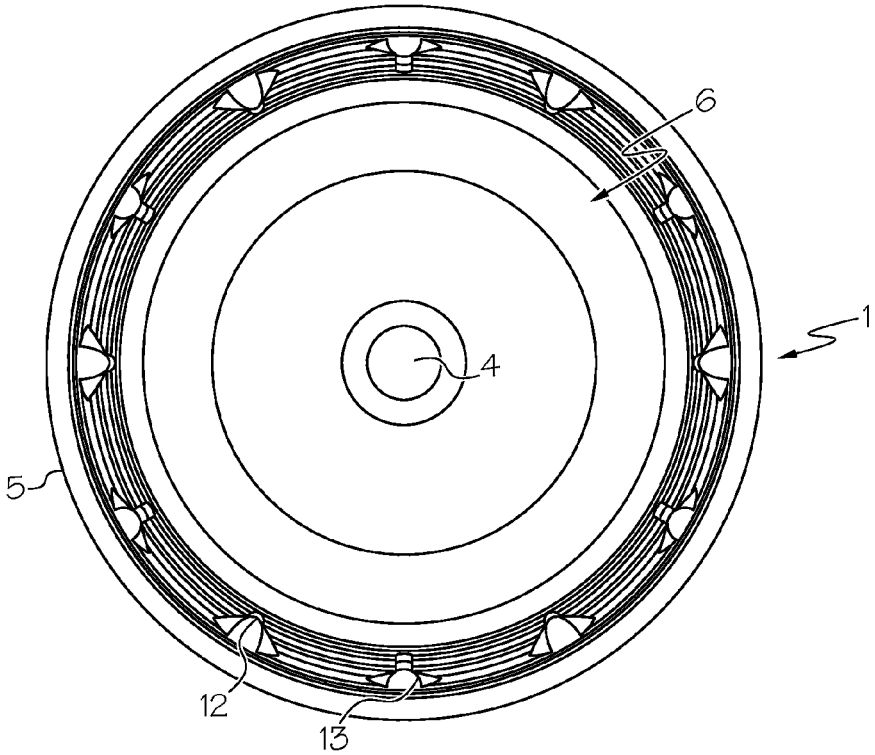
Figure 1E:
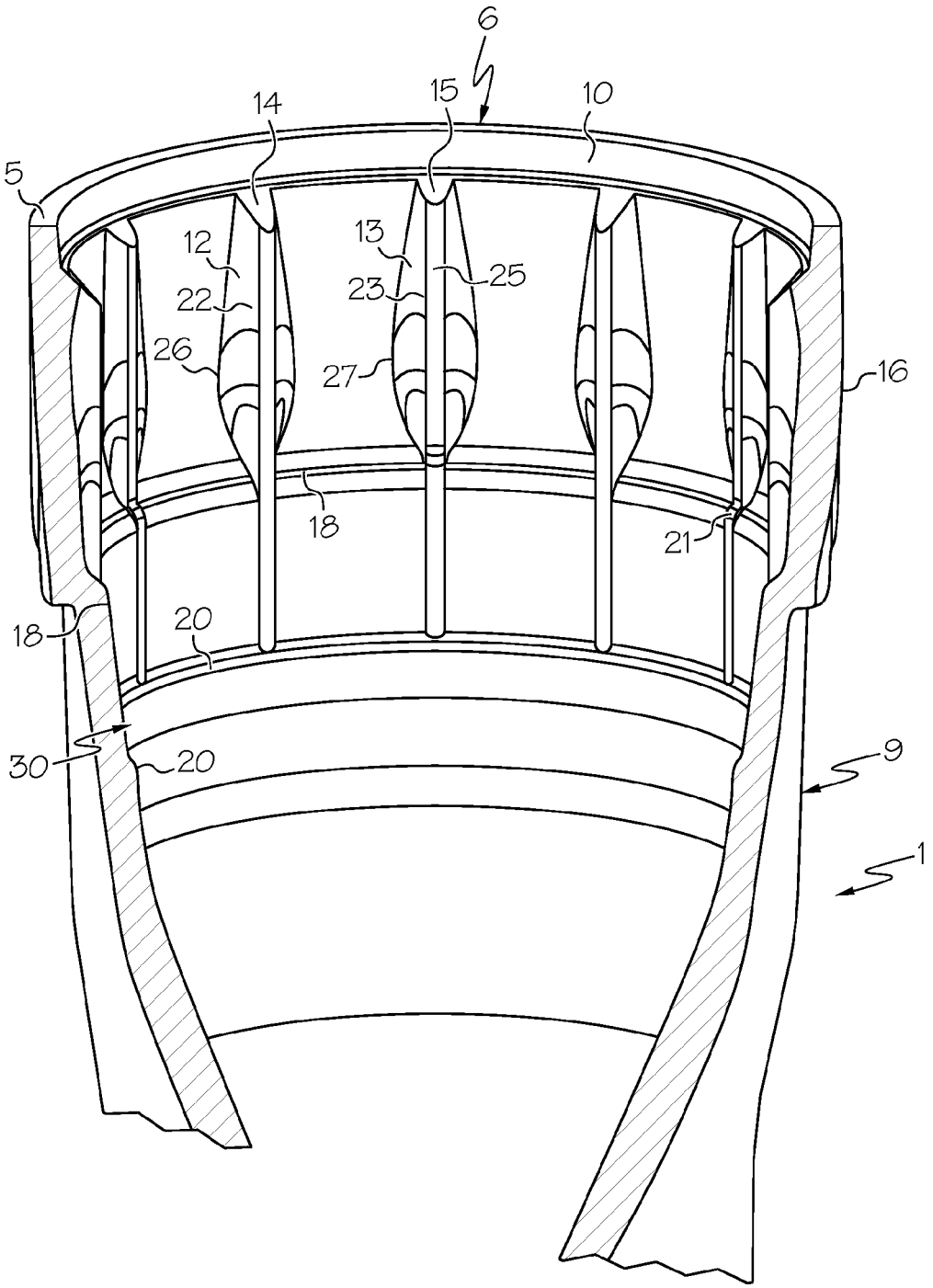

Immediately adjacent to the upper opening 6, the head portion 9 has an introduction area 10 with dilated diameter, which extends only over a short part of the head portion 9. Below the introduction area 10 joins a retaining area 11, in which ribs 12, 13 project towards the inside from the inner circumference of the head portion. They are axially extending ribs 12, which project farther radially towards the inside, and further axially extending ribs 13 which project a lesser distance towards the inside. In FIGS. 1*d* and *e*, one clearly recognizes that the ribs 12 project farther from the inner circumference of the pipette tip 1 than the further ribs 13. One further rib 13 is always disposed between two ribs 12.

At the topside, the ribs 12 and the further ribs 13 each have a short chamfer 14, 15 next to the introduction area 10.

At its topside, the head portion 9 has a cylinder area 16 that projects towards the outside. The latter is limited by an outer step 17 at its downside. At the inside, the head area has an inner step 18. The ribs 12 and the further ribs 13 extend across the inner step 18. At the downside, they end in a sealing area 19. There, a circulating sealing nose 20 in the shape of a bead projects from the circumference of the head portion 9 at the inside. The ribs 12 and the further ribs 13 extend up to the sealing nose 20. The further ribs 13 have a jump position 21 in the area of the inner step 18.

The ribs 12 and the further ribs 13 have a parabolic profile 22, 23 in the area above the inner step 18. The profile has a flattening 24, 25 in that area which projects farthermost towards the inside. At first, the parabolic profile 22, 23 dilates in the direction from up to down, up to a position 26, 27 of maximum width; from there it becomes narrower again up to the inner step 18.

Further, the head area has drop-shaped, outwardly projecting flutings 28 on the circumference of the cylinder area 16 at the outside. Above the inner step 18, the edges of the flutings 28 overlap with the edges of the ribs 12 and those of the further ribs 13.

Below the sealing nose 20, a conical braking area 29 joins the sealing area 19, and tapers downwardly and dilates upwardly, respectively.

In the area of the ribs 12, 13 the head portion 9 is slightly conical at the inside above the inner step 18 and below the inner step 18 as well as in the sealing area 19. In the braking area 29, it is more conical.

The area of the further ribs 13, the sealing area 19 and the braking area 29 will be summarized as "seat area" 30.

Below the braking area 29, the centre portion 8 limits the body 2.

Figure 2:
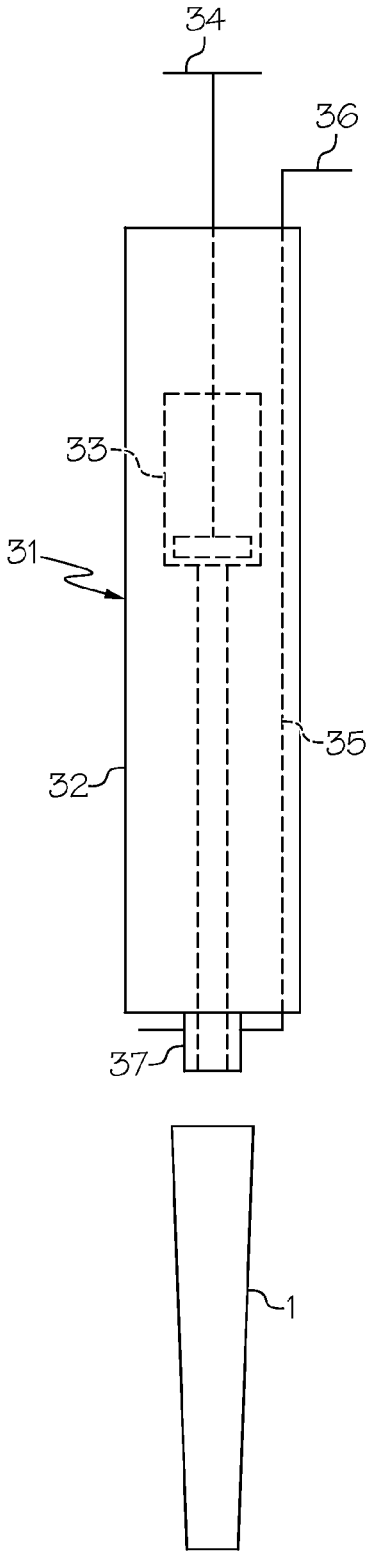
FIG. 2 a pipette tip with attachment piece when the pipette tip of FIG. 1 is being plugged, in a side view.

According to FIG. 2, a hand-held pipette 31 has a housing 32 in the form of a hand grip, which contains a displacer element 33 for displacing air, and on which is arranged an actuation element 34 for actuating the displacer device 33, as well as an ejector 35 with an associated further actuation element 36. At the downside, a standardized conical attachment piece 37 is disposed on the downside of the housing 32.

A pipette tip 1 can be plugged onto the attachment piece 37.

Figure 3:
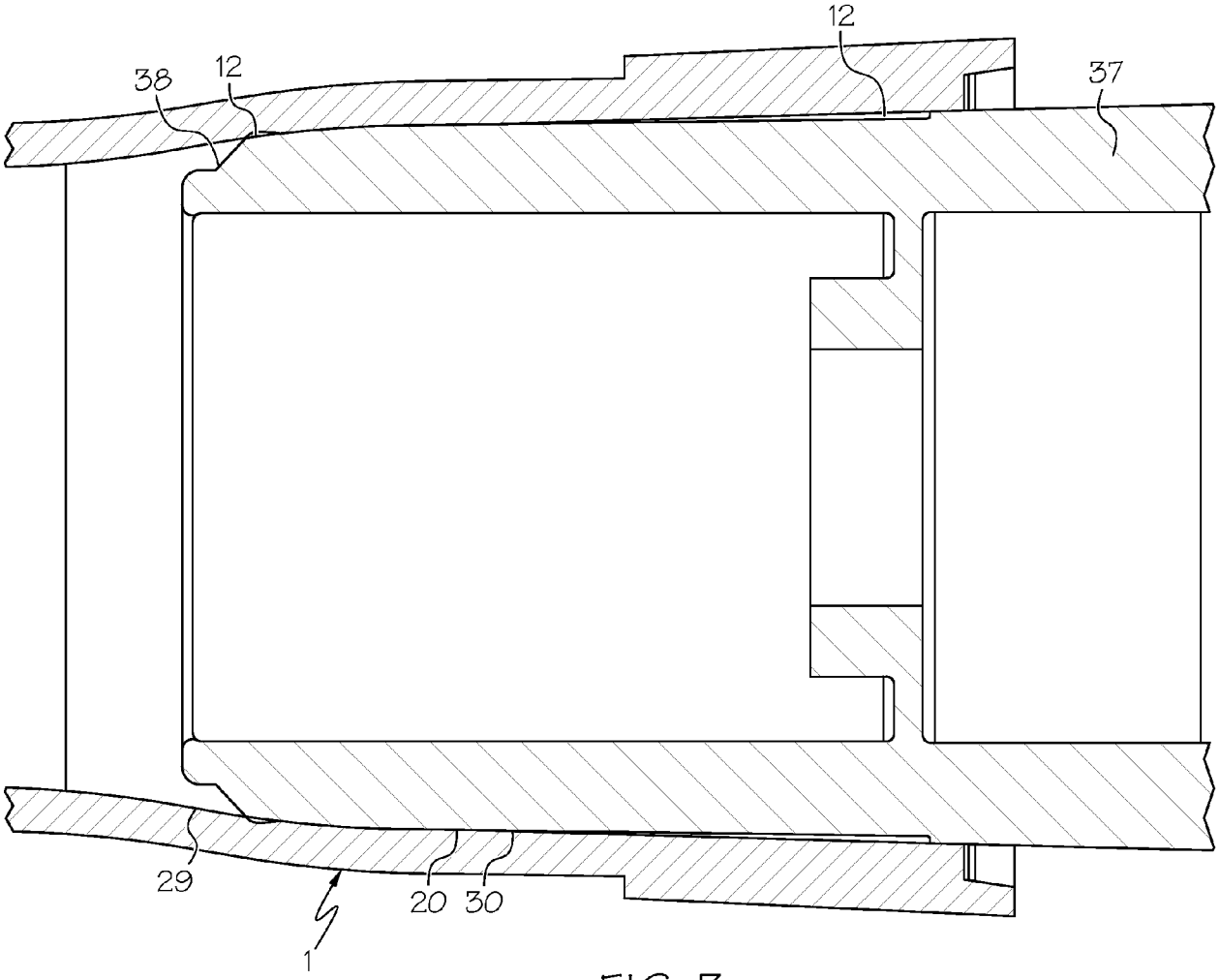
FIG. 3 the attachment piece, inserted into the seat area of the pipette tip of FIG. 1, in a partial longitudinal section.

According to FIG. 3, the ribs 12 are partly plastically deformed when the pipette tip 1 is plugged onto the standardized conical attachment piece 37 with its seat area 30. This is the case in the overlap area of the contours of the attachment piece 37 and of the ribs 12 in FIG. 3. The wall of the pipette tip 1 is slightly elastically deformed between the ribs 12 and the further ribs 13. In the area of the sealing nose 20, the seat area 30 is elastically deformed in that the wall is somewhat deflected towards the outside with respect to the shown position, in which the contours of the sealing nose 20 and the attachment piece 37 overlap each other.

The braking area 29 is plastically deformed in the area of the lower end 38 of the attachment piece 37 (at the left in FIG. 3). This is the case where the contours of the lower attachment piece end 38 and the braking area 29 overlap.

Figure 4A:
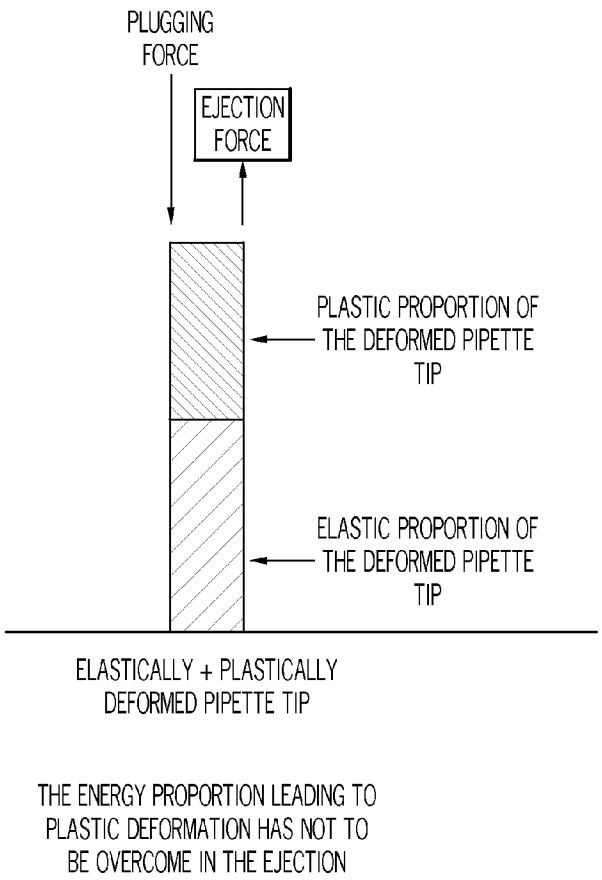
FIG. 4 a comparison of the plugging- and ejection forces of the pipette tip of the present invention (FIG. 4*a*) and with conventional pipette tips (FIG. 4*b*)

According to FIG. 4*a*, a part of the plugging force is needed for the plastic deformation of the pipette tip. A further part of the plugging force is allotted to the elastic portion of the deformation of the pipette tip 1. Thus, a part of the plugging force is irreversibly consumed for the plastic deformation of the pipette tip 1. The ejection force needed for ejecting the pipette tip 1 from the attachment piece has only to overcome that part of the plugging force which is allotted to the elastic deformation of the pipette tip 1.

Figure 4B:
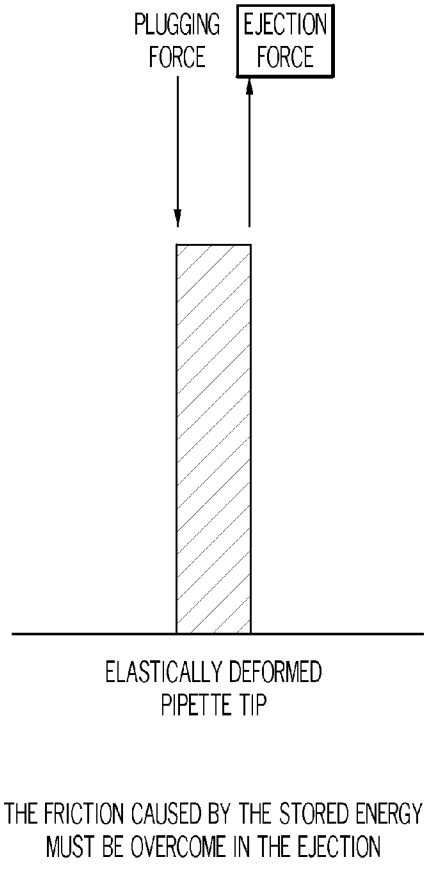
Figure 5I:
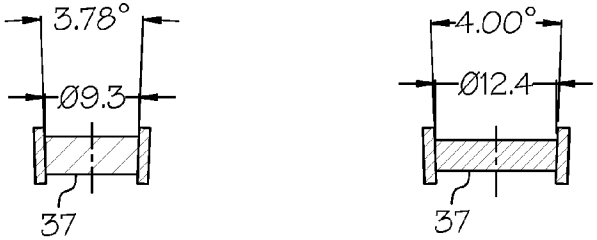
FIG. 5 average diameter and cone angle of standardized conical attachment pieces for plugging on pipette tips of different sizes, in an overview.
Figure 5I:
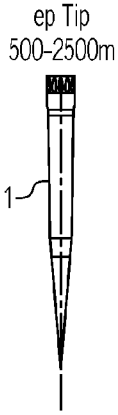
Figure 5J:
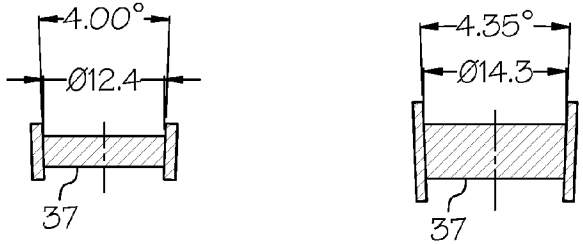
Figure 5J:
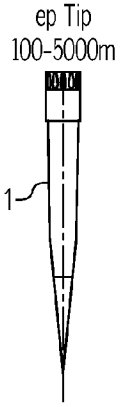
Figure 5K:
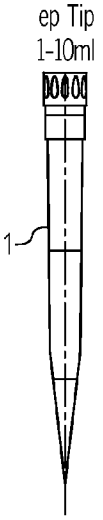
Figure 5L:
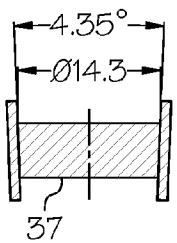
Figure 5L:
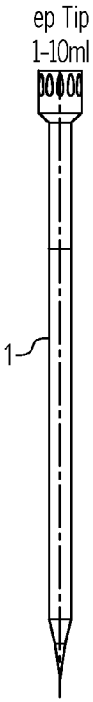

Thus, with the pipette tip 1 of the present invention, the ejection force is smaller than with a conventional pipette tip, which is only elastically deformed by the plugging force. In conventional pipette tips, plugging force and ejection force are coincident. This is shown in FIG. 4*b*.

FIG. 5 shows the respective average diameter and cone angle of a standardized conical attachment piece 37 above an associated pipette tip 1 with a certain syringe size. The average diameter is indicated in millimetres and the cone angle in degrees. As a degree for the pipette tip size, the respective range of the filling volume with which the pipette tip 1 can be filled is indicated in microlitres and millilitres, respectively. The average diameter of the attachment piece 37 relates to a diameter between lower and upper end of the attachment piece 37. It must not imperatively be dealt with a diameter which is disposed exactly in the middle between lower and upper end of the attachment piece. However, the average diameter can also fall exactly into the middle between lower and upper end of the attachment piece.

In addition, the tolerances for the average diameter (+/−0.05 mm) and for the angle indications (+/−0.3°) are indicated in FIG. 5. The attachment pieces 37 are produced with corresponding tolerances.

This completes the description of the preferred and alternate embodiments of the invention. Those skilled in the art may recognize other equivalents to the specific embodiment described herein which equivalents are intended to be encompassed by the claims attached hereto.

LIST OF REFERENCE SIGNS

1 pipette tip
2 tubular body
3 lower end
4 lower opening
5 upper end
6 upper opening
7 conical beginning portion
8 conical centre portion
9 head portion
10 introduction area
11 retaining area
12 axially extending ribs
13 further axially extending ribs
14 short chamfer
15 further short chamfer
16 cylinder area
17 outer step
18 inner step
19 sealing area
20 sealing nose
21 jump position
22 parabolic profile
23 further parabolic profile
24 flattening
25 flattening
26 position of maximum width
27 position of maximum width
28 drop-shaped flutings
29 conical braking area
30 seat area
31 hand-held pipette
32 housing
33 displacer element
34 actuation element
35 ejector
36 further actuation element
37 conical attachment piece
38 lower end of attachment piece

What is claimed is:

1. A pipette tip having the shape of an elongate tube with a lower opening (4) at a lower end (3) for the passage of liquid, and an upper opening (6) at an upper end, wherein a seat area (30) exists on an inner circumference contiguous to the upper opening (6), which serves for plugging it onto a conical attachment piece (37) of a pipetting device (30), wherein the seat area (30) has a retaining area (11) with axially extending ribs (12) projecting radially towards the inside from the inner circumference of the head portion, and below the retaining area (11) a sealing area (19) and is configured such that when the pipette tip (1) is plugged onto the attachment piece (37) with its seat area (30) by a plugging force which ensures retaining and sealing of the pipette tip (1) on the attachment piece (37), the ribs (12) are partly plastically deformed, and elastic deformation occurs in the seat area (30) outside of the ribs (12).

2. A pipette tip according to claim 1, wherein the ribs (12) are uniformly distributed over the circumference.

3. A pipette tip according to claim 1, the pipette tip comprising 3 to 12 ribs (12).

4. A pipette tip according to claim 1, wherein the ribs (12) are dimensioned such that their dimensional overlap with the standardized conical attachment piece (37) in relation the position which the attachment piece (37) occupies when the pipette tip (1) is plugged onto the attachment piece (37) by a plugging force which ensures retaining and sealing of the pipette tip (1) on the attachment piece (37), is at least 0.1 mm and maximally 0.5 mm.

5. A pipette tip according to claim 1, which has, next to the upper opening (6), further axially extending ribs (13) at the inside from the inner circumference of the head portion, projecting radially towards the inside from the inner circumference of the head portion, which extend less far radially towards the inside from the inner circumference of the head portion than the ribs, the further axially extending ribs each being arranged between two ribs.

6. A pipette tip according to claim 5, wherein the ribs (12) are dimensioned such that they are not deformed when the pipette tip (1) is plugged onto the attachment piece (37) by a plugging force which ensures retaining and sealing of the pipette tip (1) on the attachment piece (37).

7. A pipette tip according to claim 5, wherein the further axially extending ribs (13) have a profile which tapers in the direction radially towards the inside.

8. A pipette tip according to claim 5, wherein the further axially extending ribs (13) have a triangle-shaped or a trapezoidal or a parabolic profile.

9. A pipette tip according to claim 5, which has flutings (28) at the circumference on the outside, which overlap the further axially extending ribs (13).

10. A pipette tip according to claim 1, wherein the ribs (12) and/or the further axially extending ribs (13) have a profile which tapers in the direction radially towards the inside.

11. A pipette tip according to claim 1 wherein the ribs (12) have a triangle-shaped or a trapezoidal or a parabolic profile.

12. A pipette tip according to claim 1, which has flutings (28) at the circumference on the outside, which overlap the ribs (12).

13. A pipette tip according to claim 1, which dilates conically towards the upper opening in the area in which the ribs (12) are disposed, and/or in the sealing area (19).

14. A pipette tip according to claim 1, which has a sealing nose (20) projecting towards the inside from the inner circumference of the head portion and circulating on the circumference in the sealing area (19).

15. A pipette tip according to claim 1, which has a wall thickness in the retaining area (11) that is greater than its wall thickness in the sealing area (19).

16. A pipette tip according to claim 1, which has means for limiting the plugging onto the standardized conical attachment piece (37), which stop the plugging onto the attachment piece (37) when a plugging force is attained which ensures retaining and sealing of the pipette tip (1) on the attachment piece (37) and a partial plastic deformation of the ribs (12).

17. A pipette tip according to claim 16, wherein the means for limiting (29) the plugging are a braking area (29) which conically dilates below the sealing area (19) towards the upper opening.

18. A pipette tip according to claim 1, which is made of a polymer material.

* * * * *